United States Patent [19]

Roberts et al.

[11] 4,385,565

[45] May 31, 1983

[54] SHELF SUPPORT

[76] Inventors: Hubert P. Roberts, 268 Wandsworth Bridge Rd., London SW6 2UA; Clifford Roberts, 11 Bathurst Ave., Merton Park, SW. 19, both of England

[21] Appl. No.: 146,686

[22] Filed: May 5, 1980

[30] Foreign Application Priority Data

May 4, 1979 [GB] United Kingdom ..... 7915604

[51] Int. Cl.[3] ..... A47B 5/00

[52] U.S. Cl. ..... 108/152; 248/235

[58] Field of Search ..... 108/152, 27, 48; 248/235, 250

[56] References Cited

U.S. PATENT DOCUMENTS

| | | | |
|---|---|---|---|
| 564,519 | 7/1896 | Heysinger | 108/152 |
| 883,323 | 3/1908 | Macduff | 248/250 |
| 2,091,599 | 8/1937 | Larson et al. | 108/23 X |
| 2,241,657 | 5/1941 | Dehring | 248/235 |
| 2,477,771 | 8/1949 | Sanford | 248/250 |
| 2,887,802 | 5/1959 | Burmeister | 108/23 X |
| 3,209,711 | 10/1965 | Pope | 108/152 |
| 3,311,435 | 3/1967 | Heritage | 108/152 |
| 3,704,675 | 12/1972 | Bellasalma | 108/152 |
| 3,994,462 | 11/1976 | Shine | 248/250 |
| 4,183,487 | 1/1980 | Savain | 248/250 |

FOREIGN PATENT DOCUMENTS

| | | |
|---|---|---|
| 1126253 | 9/1968 | United Kingdom . |
| 1214455 | 12/1970 | United Kingdom . |

*Primary Examiner*—Francis K. Zugel

*Attorney, Agent, or Firm*—Larson and Taylor

[57] ABSTRACT

A shelf support formed as a continuous section to run the length of the shelf and hold it as a cantilever by the co-operation of a support surface designed to lie below the shelf and a retaining ridge disposed to engage the upper face of the shelf near its edge.

1 Claim, 5 Drawing Figures

SHELF SUPPORT

The invention relates to shelf supports.

We have looked at currently available shelf supports and found many of them untidy and with obtrusive fixings.

We have realised that a very neat system is given if a shelf support is a continuous section that runs the length of the shelf and holds it as a cantilever by the cooperation of a support surface disposed to lie below the shelf and a retaining ridge disposed to engage the upper face of the shelf near its edge.

Preferably fixing means for the support, for example screw holes, lie below the ridge and are hidden by the edge of the shelf when in place. Such holes may be preformed or made by the user, and in the latter case it may be convenient for a guide groove to be present in the material of the support in an outwardly facing surface between the support surface and the retaining ridge, to help accurate drilling.

The shelf may be for storage or display or other purposes including seating, the point of the invention being the way it is supported rather than what it is for. It may for example be retained between the support surface and the ridge as a press fit, by double sided adhesive tape, by screws through the support into the shelf at the ends, or simply under its own weight, possibly aided by one or more narrow ridges or other formations in the support designed to bite into the material of the shelf.

In a convenient construction the support serves also as a conduit for a lighting or other electrical supply for example for the illumination of display shelves.

The support may be made in sizes to take for example glass or standard veneered chipboard or the like, a typical width of the support being for example one quarter to one third of the width of the shelf it is intended for. A far lighter construction of support than would be satisfactory for individual brackets can be used, and fixings can be well spaced since each one helps the next.

The support can be for example extruded from aluminium, other metal or plastics; rolled from sheet metal strip; cast; or fabricated. Extruded aluminium is preferred as neat, dimensionally stable and strong.

If required, end pieces can be provided to cover the ends of the support and the shelf. Conveniently they are double faced so that separate left and right hand pieces are not needed.

The invention is illustrated by the accompanying drawings of various embodiments, where:

Figure 3:
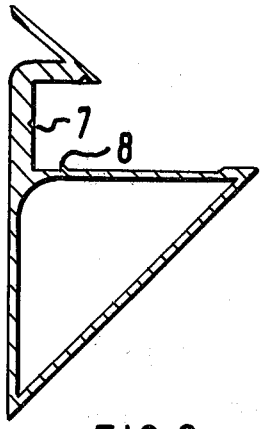
Figure 2:
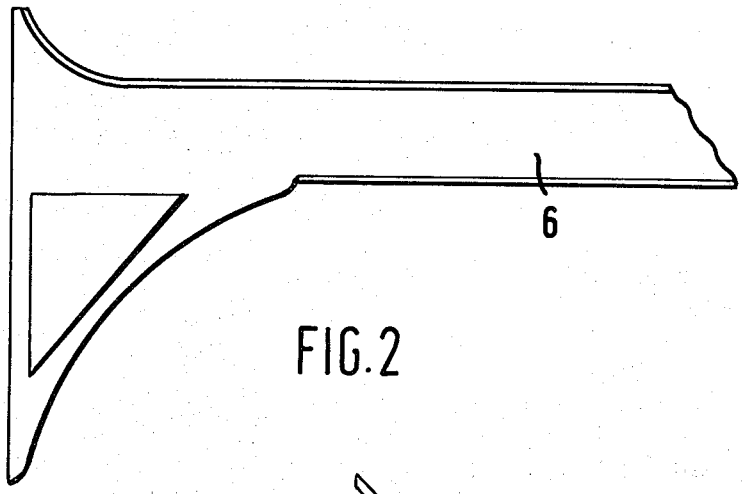
FIG. 2 is a view of part of an end piece.
Figure 2A:
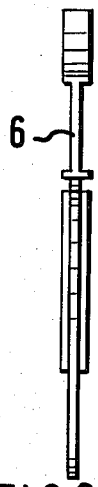

FIG. 2*a* is an end view of the end-piece;

FIG. 3 is a section of a further support; and

Figure 4:
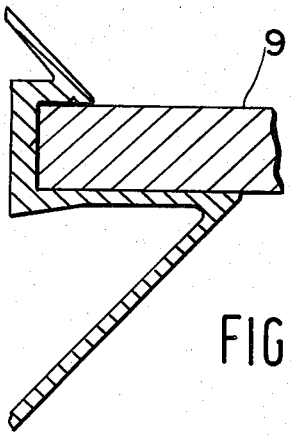

FIG. 4 is a section of a further support again.

Figure 1:
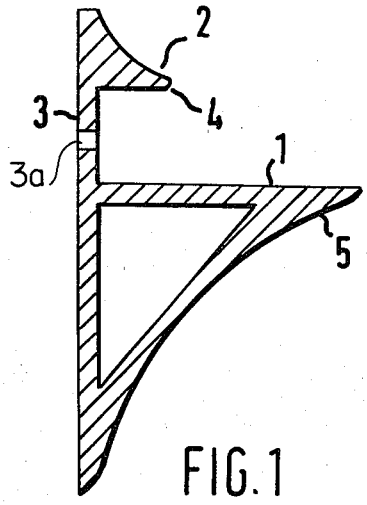
FIG. 1 is a section of a support.

The supports and the end piece are of aluminium. The supports are extruded sections with a support surface 1, approximately one and a half to two inches (3 to 5 cm) wide, and a retaining ridge 2 for a six inch (15 cm) wide veneered chipboard shelf (not shown). Screw holes for fixing can (as indicated at 3*a* in FIG. 1) be provided in the outward facing surface 3 of the support, where they will be hidden by the board when it is inserted. The gap between the support surface 1 and the ridge 2 gives a push fit for the shelf, entry being aided by the chamfer 4. The shelf stays in place under its own weight, the effect being increased when it is loaded, but if desired holes for small pins can be provided in the outer edge of the support at 5, for security against vibration, pulling by children or other disturbance.

The end pieces, as shown in FIG. 2, extend to cover the end face of the shelf, giving a neat finish. Their shape corresponds to the support and they can be fixed in any convenient way, for example by pins through holes in the flange 6 into the shelf.

In use the support can be bought to standard shelf lengths or cut as required.

The alternative supports of FIGS. 3 and 4 have a guide groove 7 for accurate vertical location of fixing screw holes at horizontal spacing to suit the application. FIG. 3 further shows a narrow ridge 8 designed to bite slightly into the surface of a chipboard or similar shelf and aid retention without excess pressure being required to insert the shelf initially. Similar ridges can be provided on other faces of the receiving channel for the shelf or for example a narrow strip of double sided pressure sensitive adhesive tape can be placed on the face 3, covered with a release paper strip taken off when the support is used.

FIG. 4 also illustrates a shelf, denoted 9, in place in the support; as shown and is evident from the construction of the support itself, the shelf completely fills the channel defined between the backing, ridge and support surfaces and is of simple rectangular cross sectional geometry.

We claim:

1. A shelf assembly comprising a shelf of substantial arbitrary length and of simple rectangular cross sectional geometry, and a shelf support therefor, said support being continuous and of a length corresponding to the length of the shelf and having a section defining (a) a backing by which the support is to be secured in position with the backing upright, (b) a support extension comprising a first portion extending outwardly from said backing to define an upward facing support surface for frictional engagement with the lower face of the inserted shelf near the edge thereof and a second portion extending downwardly and inwardly to a location where the second portion is joined to the backing, said first and second portions and said backing defining a hollow space therebetween which is capable of serving as a conduit for a lighting or other electrical supply, and (c) a retaining ridge also extending outwardly from said backing but to a lesser extent than said support extension to define a downward facing retaining surface directly opposed to said support surface for frictional engagement with the upper surface of said inserted shelf and spaced therefrom by the thickness of the shelf, said support surface and retaining surface constituting opposed sides of a channel running the length of the support which receives the said one longitudinal side of the shelf with the shelf being slid in for retention cantilverwise with the weight taken by a downward force of the underside of the shelf on the support surface and an upward force of the upper side of the shelf on the retaining surface, said shelf completely filling the channel defined by said support surface, said retaining surface and the backing, and said support surface including, at a position thereof which opposes said retaining surface, a narrow upwardly projecting formation for biting into the material of the shelf, said formation extending the length of said support surface.

* * * * *